US011143463B2

(12) United States Patent
Singh et al.

(10) Patent No.: US 11,143,463 B2
(45) Date of Patent: Oct. 12, 2021

(54) THERMAL STRESS RELIEF STIFFENER

(71) Applicants: DENSO International America, Inc., Southfield, MI (US); DENSO CORPORATION, Kariya (JP)

(72) Inventors: Guriqbal Singh, Farmington Hills, MI (US); Jason Spenny, Berkley, MI (US); Osamu Hakamata, Kariya (JP)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 59 days.

(21) Appl. No.: 16/026,994

(22) Filed: Jul. 3, 2018

(65) Prior Publication Data

US 2019/0072341 A1 Mar. 7, 2019

Related U.S. Application Data

(60) Provisional application No. 62/553,150, filed on Sep. 1, 2017.

(51) Int. Cl.
*F28F 9/00* (2006.01)
*F28F 9/02* (2006.01)
(Continued)

(52) U.S. Cl.
CPC ..... *F28F 9/0224* (2013.01); *F28D 1/05375* (2013.01); *F28D 2021/0091* (2013.01);
(Continued)

(58) Field of Classification Search
CPC .. F28F 9/00; F28F 9/0224; F28F 9/185; F28F 9/013; F28F 21/084; F28F 9/187;
(Continued)

(56) References Cited

U.S. PATENT DOCUMENTS 3,788,824 A * 1/1974 Singleton, Jr. et al. ..... B23K 35/002 428/654
5,510,869 A 4/1996 Affolter et al.
(Continued)

FOREIGN PATENT DOCUMENTS

DE 19935688 A1 2/2001
DE 10354382 A1 6/2005
(Continued)

OTHER PUBLICATIONS

Image of DNJP Stiffener from Denso International, Inc.; retrieved Aug. 23, 2017; 1 page.
(Continued)

*Primary Examiner* — Harry E Arant
(74) *Attorney, Agent, or Firm* — Harness, Dickey & Pierce, P.L.C.

(57) ABSTRACT

A stiffener for a heat exchanger includes a top plate and at least two legs extending from opposing sides of the top plate. Each of the at least two legs includes a bent portion, an angled portion, and a straight portion. The bent portion attaches the leg to the top plate. The angled portion increases
(Continued)

a width of the stiffener from a width of the top plate. The straight portion extends perpendicular to a plane of the top plate.

13 Claims, 5 Drawing Sheets

(51) Int. Cl.
*F28D 1/053* (2006.01)
*F28D 21/00* (2006.01)

(52) U.S. Cl.
CPC ..... *F28D 2021/0094* (2013.01); *F28F 9/028* (2013.01); *F28F 2225/04* (2013.01); *F28F 2225/08* (2013.01)

(58) Field of Classification Search
CPC ..... F28F 9/007; F28F 9/02; F28F 2225/04; F28F 2245/00; F28F 9/028; F28F 2225/00; F28D 1/05375; F28D 1/05366; F28D 2021/0082; F28D 2021/0091; F28D 2021/0094
See application file for complete search history.

(56) References Cited

U.S. PATENT DOCUMENTS

| | | | | |
|---|---|---|---|---|
| 2007/0131404 | A1* | 6/2007 | Overbury ..... | F28F 9/185 165/178 |
| 2007/0144718 | A1 | 6/2007 | Heine et al. | |

FOREIGN PATENT DOCUMENTS

| | | | | |
|---|---|---|---|---|
| DE | 102006057314 | A1 | | 8/2007 |
| JP | S57-021733 | A | | 2/1982 |
| JP | H02-089562 | A | | 3/1990 |
| JP | H06-194087 | A | | 7/1994 |
| JP | H07-325365 | A | | 12/1995 |
| JP | 2009204217 | A | * | 9/2009 |
| JP | 2011-038655 | A | | 2/2011 |
| JP | 201297916 | A | | 5/2012 |
| JP | 2012097915 | A | * | 5/2012 |

OTHER PUBLICATIONS

Image of Valeo Stiffener from Valeo, Inc.; retrieved Aug. 23, 2017; 1 page.

* cited by examiner

THERMAL STRESS RELIEF STIFFENER

CROSS-REFERENCE TO RELATED APPLICATIONS

This application claims the benefit of U.S. Provisional Application No. 62/553,150, filed on Sep. 1, 2017. The entire disclosure of the above application is incorporated herein by reference.

FIELD

The present disclosure relates to radiator tube stiffeners, and specifically, to a thermal stress relief stiffener.

BACKGROUND

This section provides background information related to the present disclosure which is not necessarily prior art.

Typical radiators include a core plate, an inlet tank, and an outlet tank. Radiator tubes extend the length of the core plate and transport coolant from the engine and across the core plate for cooling. During radiator use, thermal issues can cause deformation of radiator tubes or tube failure. As cooling requirements for radiators are increased, the thermal stresses on the joints between the tube and the core plate are also increased. Tube inserts may be used in radiators to mitigate test failures due to thermal shock. Adding a tube stiffener increases the stiffness and reduces stress concentrations at the joint between the tube and the core plate.

SUMMARY

This section provides a general summary of the disclosure, and is not a comprehensive disclosure of its full scope or all of its features.

An example stiffener for a heat exchanger according to the present disclosure includes a top plate and at least two legs extending from opposing sides of the top plate. Each of the at least two legs includes a bent portion, an angled portion, and a straight portion. The bent portion attaches the leg to the top plate. The angled portion increases a width of the stiffener from a width of the top plate. The straight portion extends perpendicular to a plane of the top plate.

The angled portion of the stiffener may extend at a first angle relative to the top plate.

The straight portion of the stiffener may extend at a second angle relative to the angled portion, where a sum of the first angle and the second angle may be ninety degrees.

The top plate and the at least two legs of the stiffener may be formed of at least two layers, where each of the at least two layers may be a different aluminum alloy.

The at least two layers of the stiffener may include a base layer and a clad layer.

The base layer may be formed of an aluminum alloy including manganese, and the clad layer is formed of an aluminum alloy including silicon.

An example heat exchanger according to the present disclosure may include a header plate, a plurality of tubes, and a stiffener. The header plate may include a plurality of openings. Each of the plurality of tubes may have an end portion inserted into one of the plurality of openings in the header plate. The stiffener may reinforce the end portion of at least one of the plurality of tubes. The stiffener may further include two legs extending from opposing sides of a top plate, where each leg includes a bent portion, an angled portion, and a straight portion. An inner portion of the angled portion may exert a force on an inside inner wall of the at least one of the plurality of tubes, deforming the stiffener and forcing the straight portion into contact with an outside inner wall.

The angled portion of the stiffener may increase a width of the stiffener from a width of the top plate to a width of the plurality of tubes.

The angled portion of the stiffener may extend at a first angle relative to the top plate.

The straight portion of the stiffener may extend at a second angle relative to the angled portion, where a sum of the first angle and the second angle is ninety degrees.

A width of the top plate of the stiffener may be equal to 0.75 times a width of the plurality of tubes.

The heat exchanger may further include an inner fillet formed between the straight portion and the outside inner wall.

The stiffener may be formed of a base layer and a clad layer, the clad layer melting during brazing to form the inner fillet.

The inner fillet may fill a gap between the straight portion and the outside inner wall.

The inner fillet may be additionally formed between the straight portion and the inside inner wall.

The stiffener may be formed of a base layer and a clad layer, wherein the clad layer coats the base layer.

The base layer may be formed of an aluminum alloy including at least one of manganese and copper.

The clad layer may be formed of an aluminum alloy including silicon.

The stiffener may further include four legs, where a first pair of legs has the two legs extending from opposite sides of the plate on a first end, and a second pair of legs has two additional legs extending from opposite sides of the plate on a second end.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
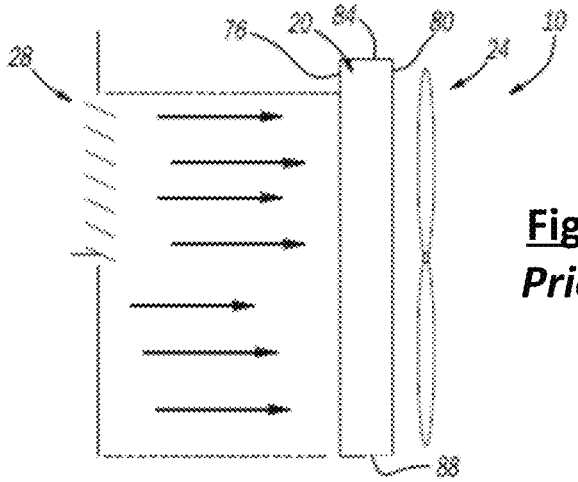
Figure 1 Prior Art
FIG. 1 is an illustration of a cooling system in a vehicle.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
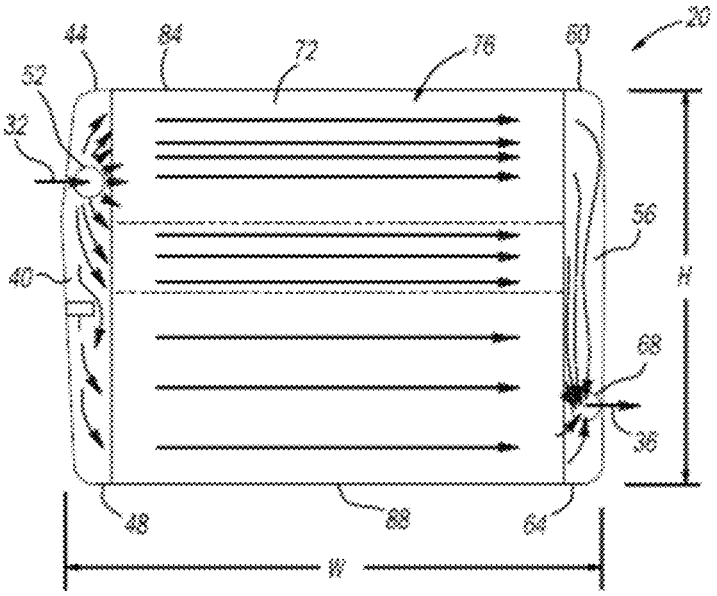
Figure 2 Prior Art
FIG. 2 is a front view of a radiator of the cooling system in FIG. 1.

With initial reference to FIGS. 1 and 2, a cooling system is generally illustrated at reference numeral 10. The cooling system 10 is suitable for cooling any suitable device, such as a vehicle engine. The engine may be installed in a vehicle, or the cooling system 10 is suitable for cooling any suitable non-vehicular engine as well. With respect to vehicles, the engine may power a passenger vehicle or any other suitable vehicle, such as any recreational vehicle, mass transit vehicle, military vehicle, construction vehicle/equipment, watercraft, aircraft, etc.

The cooling system 10 further includes a heat exchanger 20, which can be any suitable heat exchanger, such as a radiator 20. The radiator 20 may be arranged between a fan 24 and a grill 28 and may include obstacles therebetween. The radiator 20 is connected to the engine by coolant tubes 32 and 36. Coolant tube 32 provides a conduit for engine coolant flowing from the engine to the radiator 20. Coolant tube 36 provides a conduit for coolant flowing from the radiator 20 back to the engine.

The radiator 20 includes an inlet tank 40, which has an upper end 44 and a lower end 48. The inlet tank 40 includes an inlet 52, which, in the example illustrated, is closer to the upper end 44 than the lower end 48. Coolant is introduced into the inlet tank 40 through the inlet 52. Thus the inlet 52 can be connected to the coolant tube 32, which extends from the engine to the inlet 52.

The radiator 20 further includes an outlet tank 56, which has an upper end 60 and a lower end 64. The outlet tank 56 includes an outlet 68, through which coolant can exit the outlet tank 56. In the example illustrated, the outlet 68 is closer to the lower end 64 than the upper end 60.

Between the inlet tank 40 and the outlet tank 56 is a core, or core plate, 72 of the radiator 20. The core 72 includes a plurality of coolant conduits (such as coolant tubes or radiator tubes, for example, shown in FIG. 3) extending between the inlet tank 40 and the outlet tank 56. The coolant conduits of the core 72 transport coolant from the inlet tank 40 to the outlet tank 56.

The radiator 20 is arranged such that an upstream side 76 faces the grill 28, and a downstream side 80 faces the fan 24. The radiator 20 has a width W extending from the inlet tank 40 to the outlet tank 56, and across the core 72. A height H of the radiator 20 extends between an upper end 84 and a lower end 88 of the core 72 (as well as between the upper end 44 and the lower end 48 of the inlet tank 40, and further between the upper end 60 and the lower end 64 of the outlet tank 56).

Figure 3:
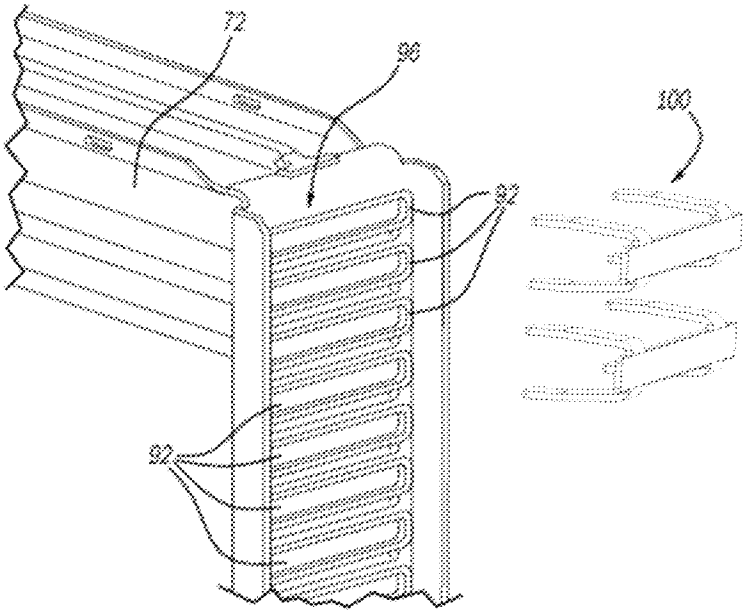
FIG. 3 is a detailed view of the radiator of FIG. 1 with an example tube stiffener according to the present disclosure.

With additional reference to FIG. 3, a view of an example core 72 before the inlet tank 40 is crimped is shown. A plurality of coolant tubes 92 terminate at an end 96 of the core 72 that meets the inlet tank 40. The coolant tubes 92, as previously mentioned, extend the width of the core 72 between the inlet tank 40 and the outlet tank 56. During use of the radiator 20, the plurality of coolant tubes 92 transports coolant from the inlet tank 40 to the outlet tank 56 to cool, or reduce a temperature of, the coolant. As coolant flows into the plurality of coolant tubes 92 at the inlet tank 40, the coolant is at an increased temperature, for example only, at or greater than a temperature at which a thermostat opens. Thus, ends of the coolant tubes 92 at the inlet tank 40 may be subject to increased stresses caused by thermal load.

A thermostat selectively permitting flow of coolant from the engine to the radiator 20 may open at, for example, 110°

C. When the thermostat opens, a temperature of the coolant tubes 92 will quickly increase from an ambient temperature to the temperature of the coolant from the engine. For example, on a cold day with an ambient temperature of approximately −20° C., the temperature of the coolant tubes 92 may ramp up from −20° C. to 110° C. in approximately 30 seconds (s). This equates to a temperature change of 130° C. in 30 s. The high temperature change in the short ramp time subjects the coolant tubes 92 to stresses caused by thermal load.

Additionally, the radiator may be subjected to tests where the temperature change and ramp time are repeated for a predetermined number of cycles to simulate a lifespan of the radiator 20. The tests may be used to simulate, for example, 15 years of vehicle life in approximately 2 weeks. For example only, the tests may require the radiator 20 to withstand the temperature delta of approximately 130° C. and ramp time of approximately 30 s for 1000 cycles.

To reduce the effects of the stress caused by thermal loading, a tube stiffener 100 may be implemented in the coolant tubes 92. The tube stiffener 100 according to the present disclosure may reduce strain on the coolant tubes 92 and prevent distortion or failure of the plurality of coolant tubes 92 from the thermal stresses. The addition of the tube stiffener 100 increases the stiffness and reduces stress concentrations at a joint between the tube and the core plate 72. For example only, a radiator tube 92 may have a thickness of 0.2 millimeters (mm) without use of the tube stiffener 100. However, the addition of tube stiffener 100 may increase the thickness of the radiator tube 92 to approximately 0.9 mm at the weakest points (i.e. at the joint between the tube and the core plate), which is an increase of 450%. By increasing the thickness, the radiator tube may be able to withstand higher stresses without deformation, distortion, or failure.

Figure 4:
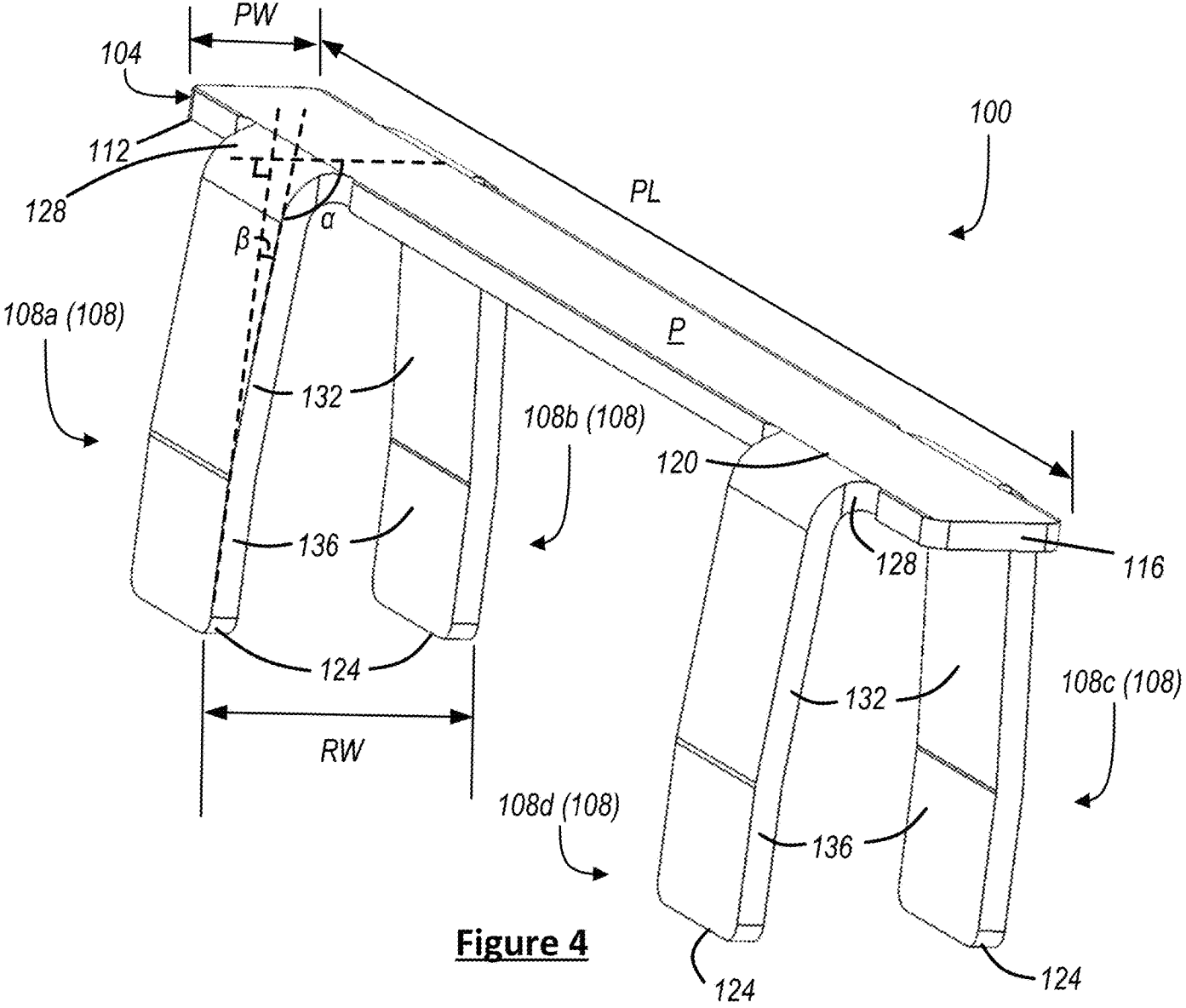
FIG. 4 is a perspective view of the example tube stiffener in FIG. 3.

With reference to FIG. 4, the example tube stiffener 100 of the present disclosure is illustrated. The tube stiffener 100 includes a plate 104, or top plate, or top flat, with four legs 108 (108*a*-108*d*) extending therefrom. The plate 104 may be an elongated rectangular shape having a length PL much longer than a width PW. For example only, the length PL of the plate 104 may be approximately equal to a thickness of the radiator 20 at the end 96. The width PW of the plate 104 may be designed to reduce bending in the legs 108 (described in detail below).

Legs 108*a*, 108*b* may extend from opposing sides of the plate 104 on a first end 112 of the plate 104. Legs 108*c*, 108*d* may extend from opposing sides of the plate 104 on a second end 116 of the plate 104. Each leg 108 may further include a first end 120 and a second end 124, with the first end 120 being fixed to the plate 104. Between the first end 120 and the second end 124 may be a bent portion 128, an angled portion 132, and a straight portion 136.

The bent portion 128 may be directly adjacent to the first end 120 and may transition the leg 108 from a position within a plane P of the plate 104 to the angled portion 132 extending at an angle α relative to the plane P of the plate 104. The angled portion 132 increases a width of the stiffener 100 from the width PW of the plate 104 to a width RW of the radiator tube 92 (also FIG. 6A). The straight portion 136 is directly adjacent to the angled portion 132 and extends at an angle approximately perpendicular to (i.e., approximately 90° from) the plane of the plate 104 and at an angle β relative to the angled portion 132. A sum of the angle α and the angle β is 90°. Upon insertion into the radiator tube 92 (FIG. 6A), the straight portion 136 contacts an outer side 140 of an inner wall 144 of the radiator tube 92 and, in use, is brazed to the inner wall 144 of the radiator tube 92.

Figure 5:
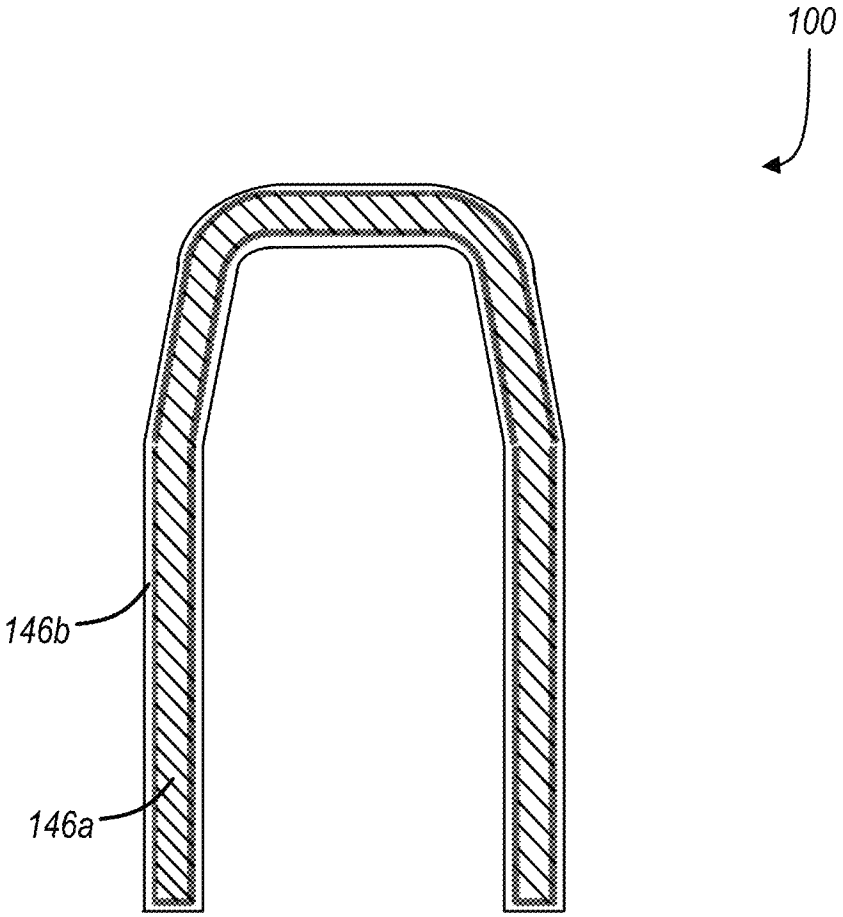
FIG. 5 is a cross-sectional view of the example tube stiffener of FIG. 4.

With reference to FIG. 5, the stiffener 100 may include one or more layers 146 of material. There may be a base layer 146*a* and a clad layer 146*b* or brazing clad. The base layer 146*a* may be the structural layer and may consume a majority (for example only, 74%±4%) of the thickness of the stiffener 100. The base layer 146*a*, as the structural component, may be formed of a stronger or stiffer material than the clad 146*b*. For example only, the base layer 146*a* may be formed of an aluminum alloy, such as an alloy containing aluminum (Al), manganese (Mn), and copper (Cu), or any other metal. The clad layer 146*b* may consume a lesser portion (for example only, an outer 13%±2% on the outside walls, totaling 26%±4% of the entire thickness) of the thickness of the stiffener 100 and may be formed of a more malleable and brazable material to promote brazing with the inner wall 144 of the radiator tube 92. For example, the clad layer 146*b* may be manufactured from an aluminum alloy, such as an alloy containing aluminum (Al) and silicon (Si), or any other brazable material.

Figure 6B:
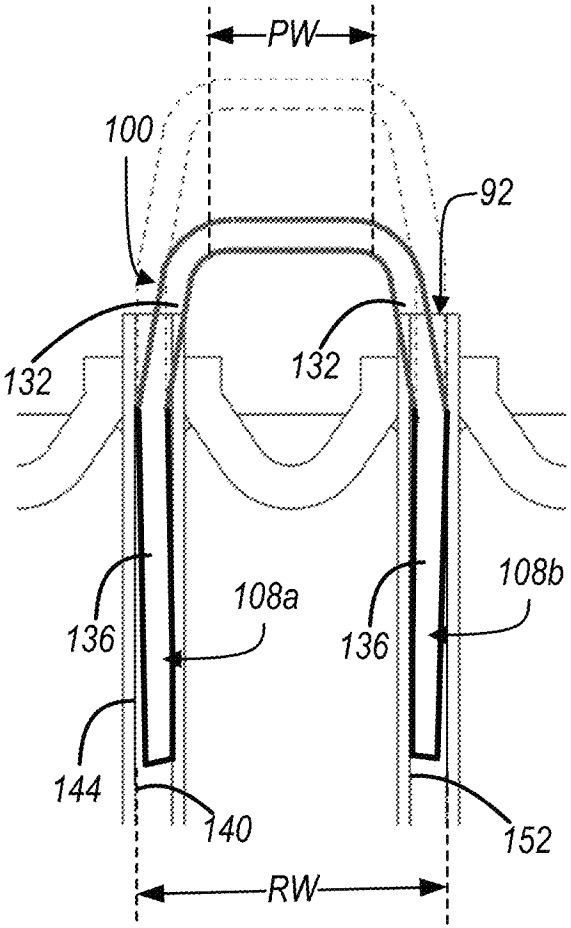
FIG. 6B is a cross-sectional view of an example tube stiffener with improper dimensions inserted into a radiator tube.
Figure 6A:
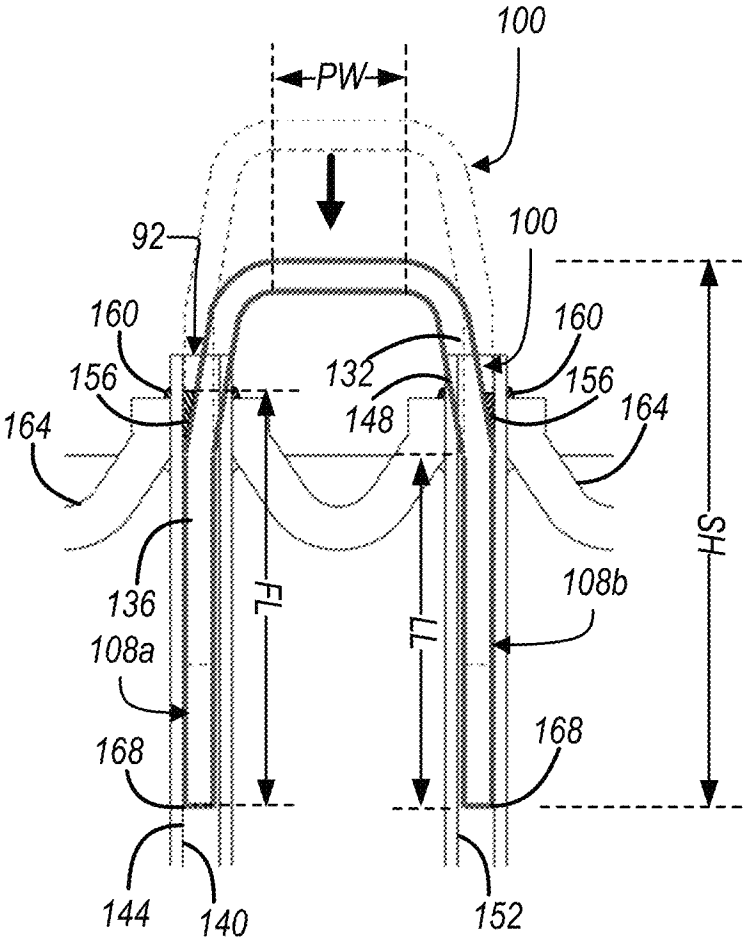
FIG. 6A is a cross-sectional view of the example tube stiffener of FIG. 4 inserted into a radiator tube according to the present disclosure.

With reference to FIG. 6A, a cross-sectional view of legs 108*a* and 108*b* inserted into the radiator tubes 92 is illustrated. As illustrated in the figure, upon insertion, an inner wall 148 of the angled portion 132 asserts a force on an inner side 152 of the inner wall 144 of the radiator tube 92 deforming the stiffener 100 and pushing the straight portions 136 of the legs 108 outward and into contact with the outer side 140 of the inner wall 144 of the radiator tube 92.

In use, the straight portions 136 of the legs 108 that contact the inner wall 144 become brazed to the inner wall 144, forming a fillet 156 between the stiffener 100 and the inner wall 144 and securing the stiffener 100 within the radiator tube 92. The fillet 156 may be the joined clad material between the inner wall 144 and the stiffener 100. In some embodiments, the fillet 156 may be formed both between the outer side 140 of the inner wall 144 and the stiffener and between the inner side 152 of the inner wall 144 and the stiffener 100.

The stiffener 100 is inserted into the radiator tubes 92 such that when the fillet 156 forms, the fillet 156 extends up the radiator tube 92 such that the fillet 156 overlaps a fillet 160 between the radiator tube 92 and a header plate 164 of the radiator 20. For example only, the fillet 156 may overlap the fillet 160 within a range of at least 5%-75%. A length LL of the straight portion 136 of the leg 108 is determined based on a starting point 168 of the fillet 156. The starting point 168 of the fillet 156 is a first touch point between the leg 108 and the inner wall 144. During the brazing process, the clad forming the fillet 156 flows into the gaps between the leg 108 and the outer side 140 of the inner wall 144 and up the leg 108/radiator tube 92 to create the fillet 156 having a fillet length FL. In some embodiments, the clad forming the fillet 156 flows into the gaps between the leg 108 and the inner side 152 of the inner wall 144.

A benefit of the described design is that it is impossible to miss a fillet target. This is important because there is no nondestructive test to determine whether a fillet target was achieved. Thus, the only way to inspect brazing is to cut apart the radiator and inspect the parts (rendering the radiator useless). The described design can, therefore, guarantee that the stiffener 100 installation and brazing is correct, ensuring quality and durability in the part.

As previously mentioned, the width PW of the plate 104 may be designed to reduce bending in the legs 108. As shown in FIG. 6B, if the width PW of the plate 104 is too close to the width RW of the radiator tubes 92, when the stiffener is inserted, no force or too little force is exerted from the angled portion 132 on the inner side 152 of the inner wall 144. As such, the stiffener 100 is not deformed such that the straight portions 136 are at an angle perpendicular to the plane of the plate 104, but, instead the straight portions 136 are angled inward and contact both sides 140, 152 of the inner wall 144 of the radiator tube 92 in the cross-sectional view, negatively impacting the performance of the stiffener 100. If portions of the legs 108 do not contact the outer side 140 of the inner wall 144 of the radiator tube 92, there could be insufficient brazing between the legs 108 and the inner wall 144, and the stiffener 100 will not perform as intended.

The width PW of the plate 104 and the length LL of the straight portion 136 of the leg 108 are dimensioned taking into account a number of factors. For example, as previously stated, the width PW may be a key factor to reduce bending. The length LL may be a key factor for surface touch. The better the interference fit between the straight portion 136 of the leg 108 and the outer side 140 of the inner wall 144, the less clad is needed on the stiffener 100 (i.e., a thinner clad layer may be used), reducing material cost. Thus, by reducing the width PW of the plate 104, the bending in the legs 108 is reduced and the interference fit improves. Once the width PW is determined, the length LL may be set to obtain the lowest clad needed for the surface touch. The dimensions and relationships between the width PW of the plate 104 and the length LL of the straight portion 136 of the leg 108 may vary based on the stiffener 100 and the radiator 20.

For example only, in one embodiment the width PW of the plate 104 may be less than or equal to approximately 75% of the width RW of the radiator tubes 92 in the cross-sectional view. Thus, if the width RW of the radiator tubes 92 is 6.4 millimeters (mm), the width PW of the plate 104 must be less than or equal to 4.8 mm. The width PW may be decreased from the 4.8 mm to reduce bending in the legs 108 and reduce the thickness of the clad layer in the legs 108. For example only, a balanced width PW may be equal to 4.6 mm±0.1 mm. At the balanced width PW, the clad may be approximately 13%±2%.

The length LL of the straight portions 136 of the legs 108 may be designed to obtain a maximum surface touch of the straight portion 136 along the outer side 140 of the inner wall 144. As the length LL is increased, the surface touch is also increased. For example only, the length LL of the straight portion 136 may be 3.9 mm±0.1 mm. Additionally, the thickness, or gauge, of the straight portions 136 may be designed based on the opening of the radiator tube 92, the type of material used, and the necessary amount of clad for the legs 108. For example, the thickness of the straight portions 136 may be 0.7 mm±0.035 mm.

An overall height SH of the stiffener 100 and an overall length of the legs 108 may be the same and may be designed relative to the dimensions of the radiator tube 92 and the core plate between the radiator tubes 92. The core plate may separate the radiator tubes 92 as shown in FIG. 6A. For example, the overall height SH of the stiffener 100 and overall length of the legs 108 may be, 10.8 mm±0.1 mm.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger comprising:

a header plate comprising a plurality of openings;

a plurality of tubes, each of the plurality of tubes having an end portion, each of the plurality of tubes being inserted into one of the plurality of openings in the header plate, and each of the plurality of tubes having an inner wall defining a through-hole in the tube; and a stiffener reinforcing the end portion of at least one of the plurality of tubes, the stiffener including two legs extending from opposing sides of a top plate, the top plate extending along a first plane, each leg including a transition, an angled segment, and a straight segment disposed orthogonal to the top plate, the angled segment extends at an angle greater than zero relative to the straight segment and extends at an angle less than ninety degrees relative to the first plane, a proximal end of the transition being connected to the top plate, a distal end of the transition being connected to the angled segment, and a proximal end of the straight segment being connected to the angled segment, wherein each of the transition, the angled segment and the straight segment extends in a first direction away from a plane defined by a top surface of the top plate such that a distal end of the straight segment is furthest from the top plate, and an inner surface of the angled segment exerts a force on a first side of an inner wall of the at least one of the plurality of tubes, deforming the stiffener and forcing an outer surface of the straight segment into contact with a second side of the inner wall, the second side being opposite the first side in a cross sectional view.

2. The heat exchanger of claim 1, wherein the angled segment increases a width of the stiffener from a width of the top plate to a width of the plurality of tubes.

3. The heat exchanger of claim 1, wherein the angled segment extends at a first angle relative to the top plate.

4. The heat exchanger of claim 3, wherein the straight segment extends at a second angle relative to the angled segment, a sum of the first angle and the second angle being ninety degrees.

5. The heat exchanger of claim 1, wherein a width of the top plate is equal to 0.75 times a width of the plurality of tubes.

6. The heat exchanger of claim 1, further comprising an inner fillet formed between the straight segment and the second side of the inner wall.

7. The heat exchanger of claim 6 wherein the stiffener is formed of a base layer and a clad layer, the clad layer melting during brazing to form the inner fillet.

8. The heat exchanger of claim 7, wherein the inner fillet fills a gap between the straight segment and the second side of the inner wall.

9. The heat exchanger of claim 6, wherein the inner fillet is additionally formed between the straight segment and the first side of the inner wall.

10. The heat exchanger of claim 1, wherein the stiffener is formed of a base layer and a clad layer, wherein the clad layer coats the base layer.

11. The heat exchanger of claim 10, wherein the base layer is formed of an aluminum alloy including at least one of manganese and copper.

12. The heat exchanger of claim 10, wherein the clad layer is formed of an aluminum alloy including silicon.

13. The heat exchanger of claim 1, wherein the stiffener includes four legs, a first pair of legs having the two legs extending from opposite sides of the top plate on a first end, and a second pair of legs having two additional legs extending from opposite sides of the top plate on a second end.

* * * * *